US007874784B2

(12) United States Patent
Teeters, II

(10) Patent No.: US 7,874,784 B2
(45) Date of Patent: Jan. 25, 2011

(54) ATTACHMENT FOR A FORKLIFT

(75) Inventor: William Edwards Teeters, II, Loxahatchee, FL (US)

(73) Assignee: Teeters Agency & Stevedoring, Inc., Riviera Beach, FL (US)

( * ) Notice: Subject to any disclaimer, the term of this patent is extended or adjusted under 35 U.S.C. 154(b) by 459 days.

(21) Appl. No.: 11/852,511

(22) Filed: Sep. 10, 2007

(65) Prior Publication Data

US 2009/0067970 A1 Mar. 12, 2009

(51) Int. Cl.
*B66F 9/06* (2006.01)

(52) U.S. Cl. ..... 414/607; 414/785

(58) Field of Classification Search ..... 414/462, 414/607, 785

See application file for complete search history.

(56) References Cited

U.S. PATENT DOCUMENTS

| | | | | |
|---|---|---|---|---|
| 3,387,731 | A | 6/1968 | Gibson et al. | |
| 3,947,064 | A * | 3/1976 | Skoting | 294/67.4 |
| 4,239,446 | A | 12/1980 | Vucinic | |
| 4,657,469 | A * | 4/1987 | Beierle et al. | 414/607 |
| 4,708,576 | A | 11/1987 | Conley | |
| 5,118,247 | A | 6/1992 | Royden | |
| 7,214,025 | B2 * | 5/2007 | Rudolph | 414/607 |
| 2003/0215318 | A1 * | 11/2003 | Buzzoni | 414/607 |
| 2006/0285960 | A1 | 12/2006 | Hitchcock | |

FOREIGN PATENT DOCUMENTS

| | | |
|---|---|---|
| KR | 20030052129 | 6/2003 |

* cited by examiner

*Primary Examiner*—Charles A Fox
(74) *Attorney, Agent, or Firm*—Buckingham, Doolittle & Burroughs, LLP

(57) ABSTRACT

An accessory for a forklift vehicle is described herein. The accessory is designed to attach to the forklift vehicle using the original forks of the forklift vehicle. The accessory provides additional forks, attached to a base bar that is wider than the width of the forklift vehicle and the original forks of the forklift vehicle. The wider forks of the accessory exist on a plane parallel to but lower than the original forks, wherein the original forks are used solely for the connection of the attachment to the forklift vehicle, and will not be in direct contact with the lifted load when the accessory is used. Only the additional forks provided by the accessory are in direct contact with the load lifted by the forklift vehicle. The wider forks provided by the forklift accessory allow the forklift to handle wider loads with ease.

14 Claims, 13 Drawing Sheets

ATTACHMENT FOR A FORKLIFT

TECHNICAL FIELD

The invention relates generally to an accessory for a forklift vehicle. More specifically, the forklift accessory explained herein extends the width of the span of the forks of the forklift allowing the forklift vehicle to handle wider loads.

BACKGROUND OF THE INVENTION

Forklift vehicles are used to lift a load and or transport a load from one location to another location. A forklift vehicle may generally have a truck proper, which is a motive machine with wheels and or driven on tracks powered through a drive train. The forklift truck is commonly fueled by liquefied petroleum gas, petrol or diesel fuel using an internal combustion engine. A cab will optionally be connected to the top rear of the truck proper, for the protection of the operator of the forklift vehicle. The forklift vehicle will have a mast connected usually to the front of the truck proper. The mast is a vertical assembly that raises, lowers and tilts the load. One or more forks will be connected to the mast. The forks are L-shaped members that engage the load.

To lift a load, the forklift vehicle will drive the one or more forks beneath the load, and position the forks in contact with the underside of the load. The forks are then raised by the mast of the forklift vehicle, lifting the load resting upon the forks. The load lifted by the forklift vehicle is commonly a standard sized container or pallet, however it is not uncommon for the forklift vehicle to be used to lift or transport an abnormally shaped load, or load that is not properly sized for transport by a forklift vehicle.

Certain forklift vehicles allow the forks to be move on a horizontal plane together or separately. Horizontal movement of the forks together allows the forks to be repositioned to the left or right of center of the forklift vehicle, and is commonly used when the forklift vehicle cannot be centered directly in front of the load. Horizontal movement of the forks separately allows the forks to be horizontally separated from one another, increasing or decreasing the width between the forks of the forklift vehicle. However, the distance between the forks of the forklift vehicle are limited by the structural design of the forklift vehicle, and not all forklift vehicles allow for the horizontal movement of the forks.

SUMMARY OF THE INVENTION

The present invention relates to an accessory and attachment for a forklift vehicle. The accessory is designed to attach to the forklift vehicle using the original forks of the forklift vehicle. The accessory provides additional forks, attached to a base bar that is wider than the width of the forklift vehicle and the original forks of the forklift vehicle. The wider forks of the accessory exist on a plane parallel to but lower than the original forks, wherein the original forks are used solely for the connection of the attachment to the forklift vehicle, and will not be in direct contact with the lifted load when the accessory is used. Only the additional forks provided by the accessory are in direct contact with the load lifted by the forklift vehicle. The wider forks provided by the forklift accessory allow the forklift to handle wider loads with ease.

An object of the present invention is to provide an accessory attachment for a forklift vehicle that expands the width of the forks of the forklift vehicle allowing the forklift vehicle to handle wider loads.

A further object of the present invention is to provide a forklift vehicle attachment that attaches to the original forks of the forklift vehicle.

Another object of the present invention is to provide a forklift vehicle attachment that provides additional forks to the forklift vehicle wherein the additional forks are the only forks that contact the load.

A further object of the present invention is to provide a forklift vehicle attachment that provides additional forks that are aligned on a horizontal plane beneath the horizontal plane of the original forks of the forklift vehicle.

Still other benefits and advantages of the invention will become apparent to those skilled in the art to which it pertains upon a reading and understanding of the following detailed specification.

These and other objects of the present invention will become more readily apparent from a reading of the following detailed description taken in conjunction with the accompanying drawings wherein like reference numerals indicate similar parts, and with further reference to the appended claims.

BRIEF DESCRIPTION OF THE DRAWINGS

The preferred embodiment of the invention, illustrative of the best mode in which applicant has contemplated applying the principals is set forth in the following description and is shown in the drawings and is particularly and distinctly pointed out and set forth in the appended claims. The invention may take physical form in certain parts and arrangements of parts, numerous embodiments of which will be described in detail in the specification and illustrated in the accompanying drawings which form a part hereof, and wherein:

DETAILED DESCRIPTION OF THE INVENTION

Figure 1:
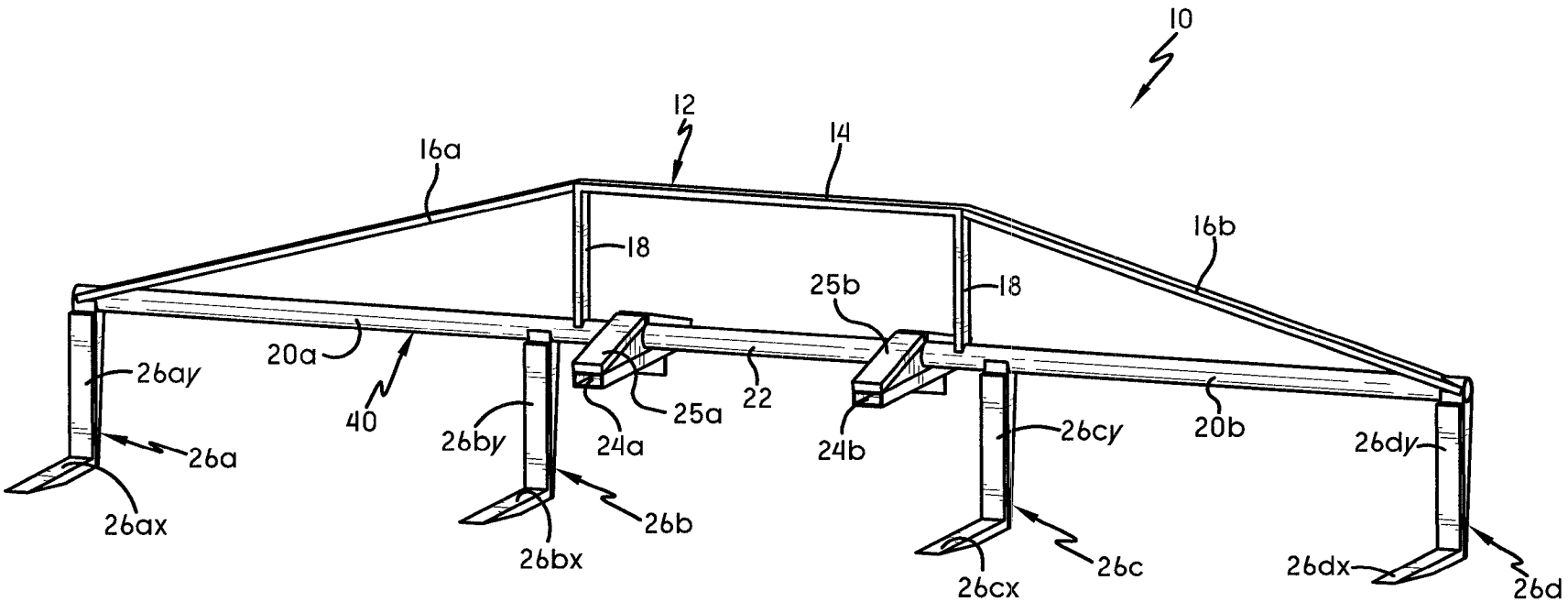
FIG. 1 is a perspective front view of the forklift attachment of an embodiment of this invention.
Figure 6:
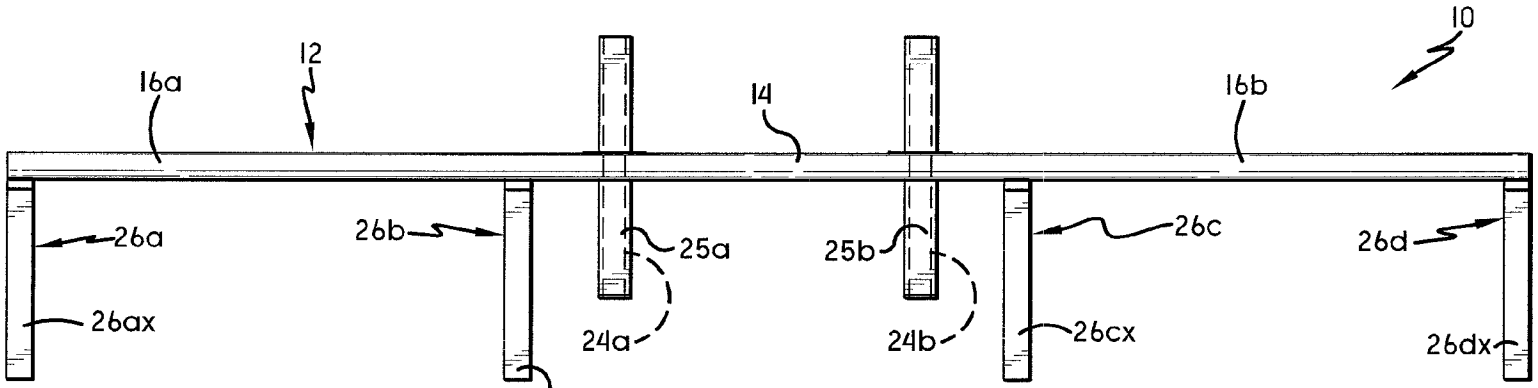
FIG. 6 is an elevational top view of the forklift attachment of an embodiment of this invention.
Figure 2:
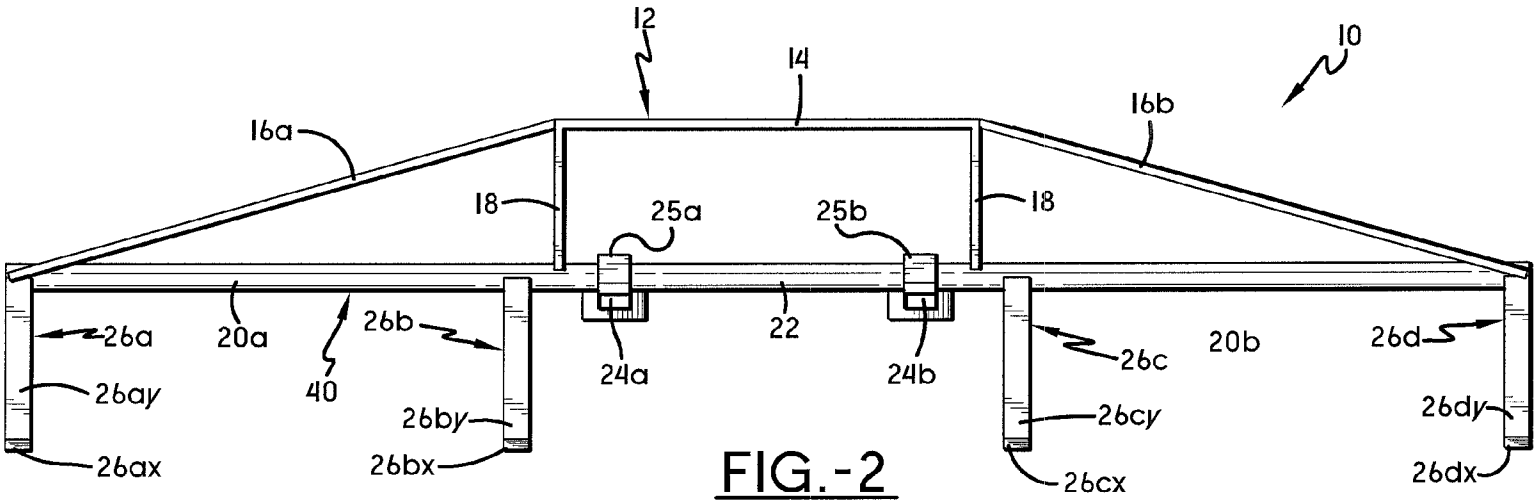
FIG. 2 is an elevational front view of the forklift attachment of an embodiment of this invention.
Figure 3:
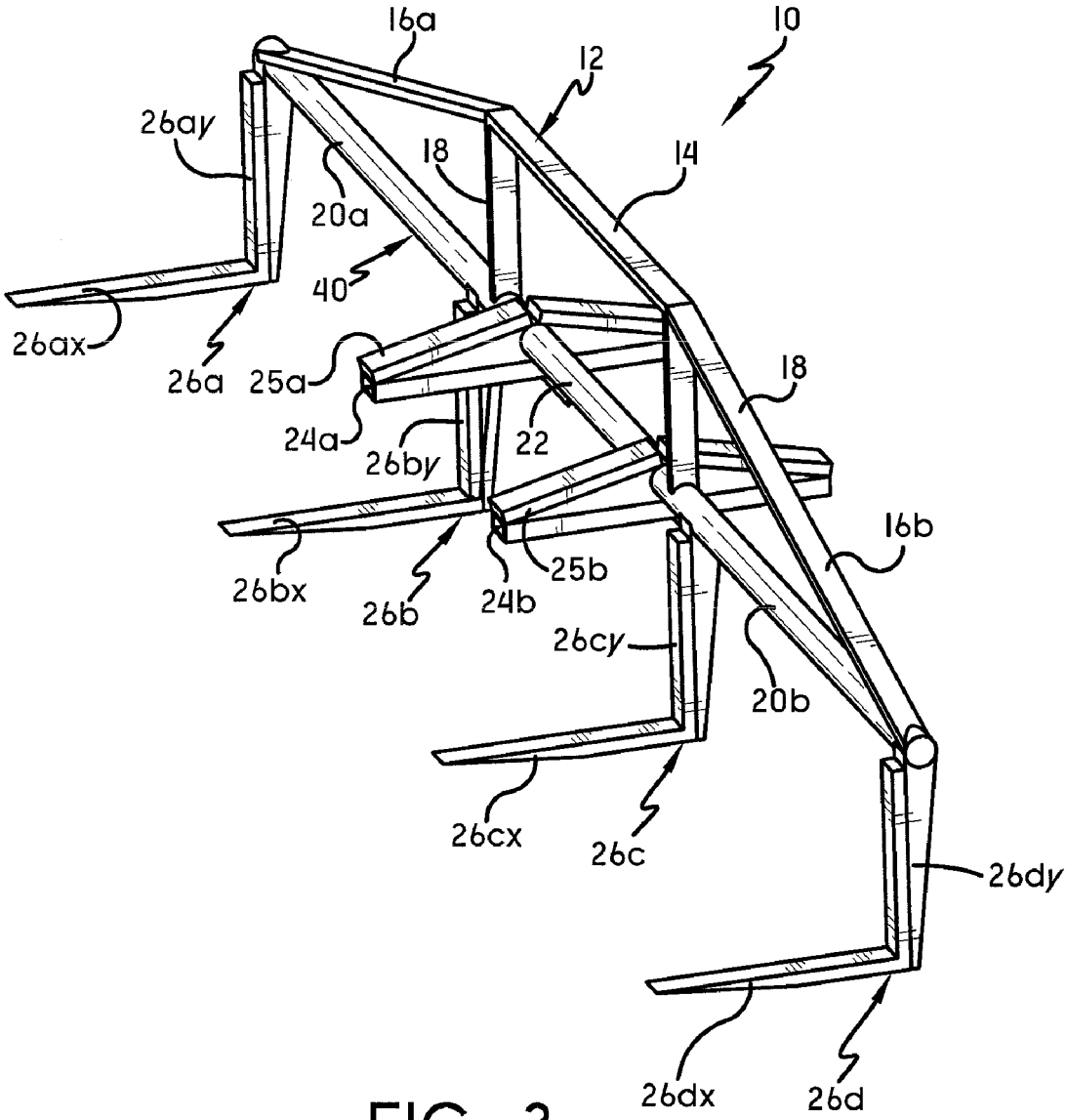
FIG. 3 is a perspective side view of the forklift attachment of an embodiment of this invention.
Figure 4:
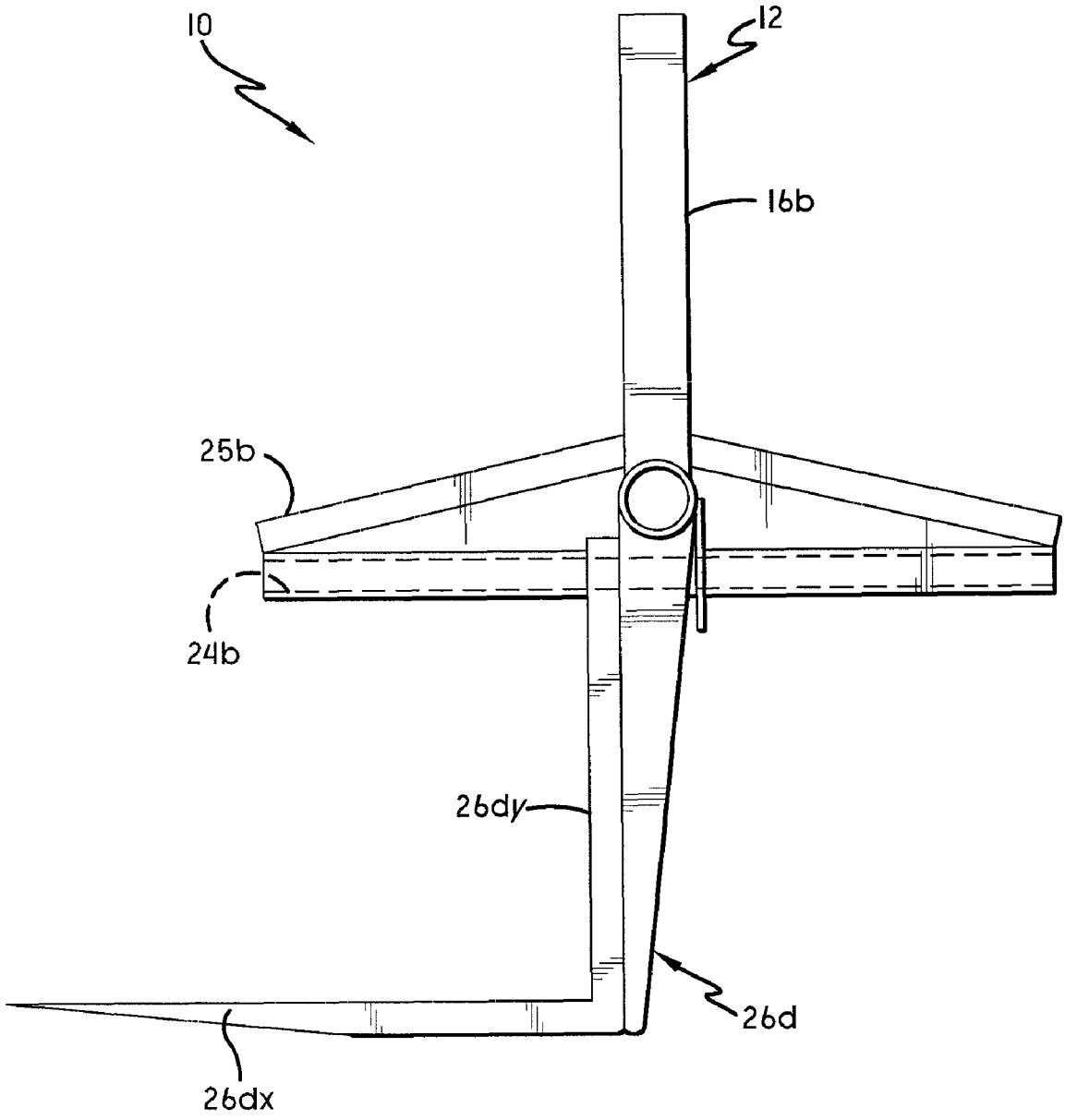
FIG. 4 is an elevational side view of the forklift attachment of an embodiment of this invention.
Figure 5:
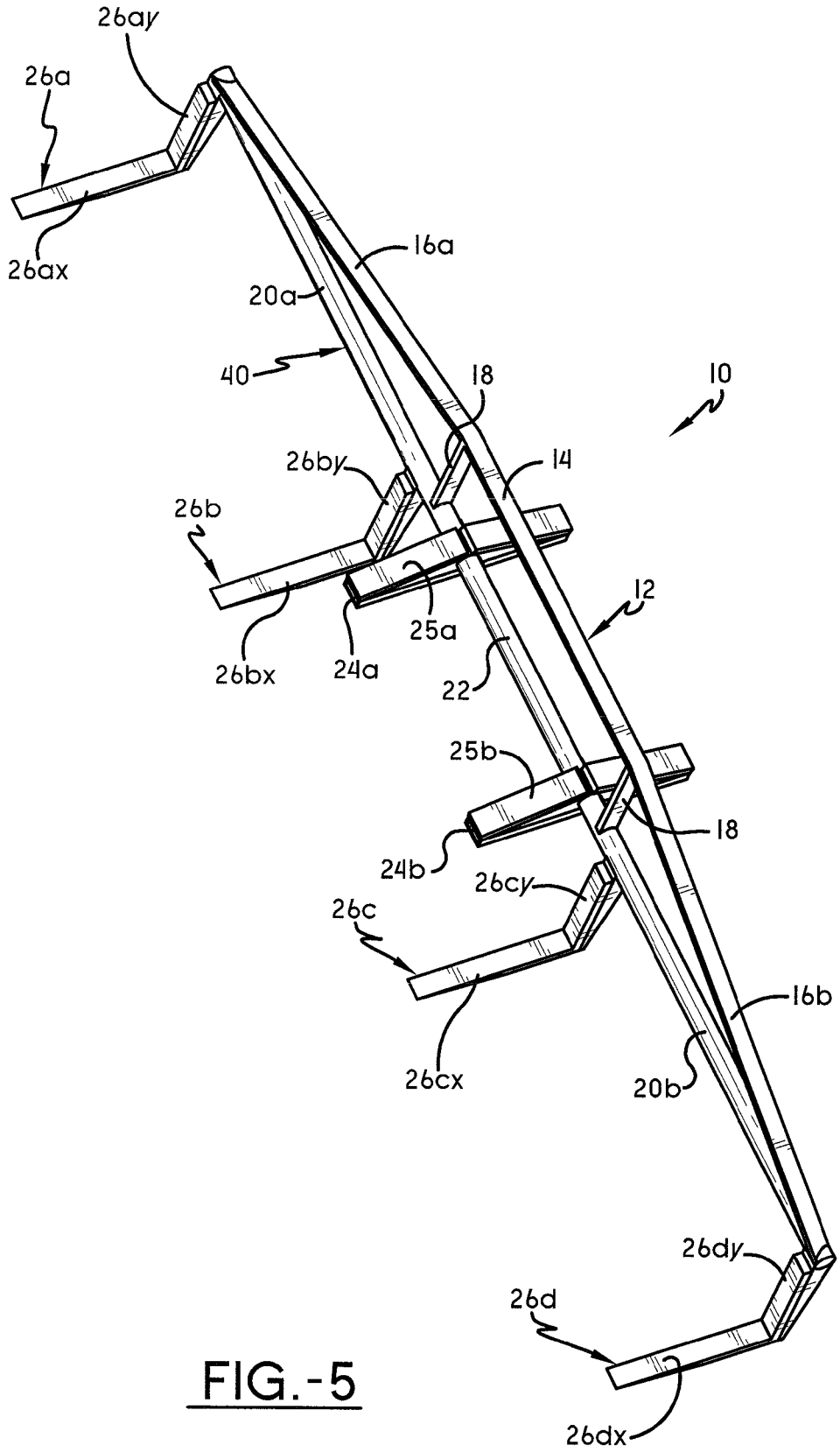
FIG. 5 is a perspective top view of the forklift attachment of an embodiment of this invention.

Referring now to the drawings wherein the showings are for purposes of illustrating various embodiments of the invention only and not for purposes of limiting the same, the figures illustrate the novel idea of an attachment for a forklift vehicle that expands the load capabilities of the forklift vehicle.

Figure 8:
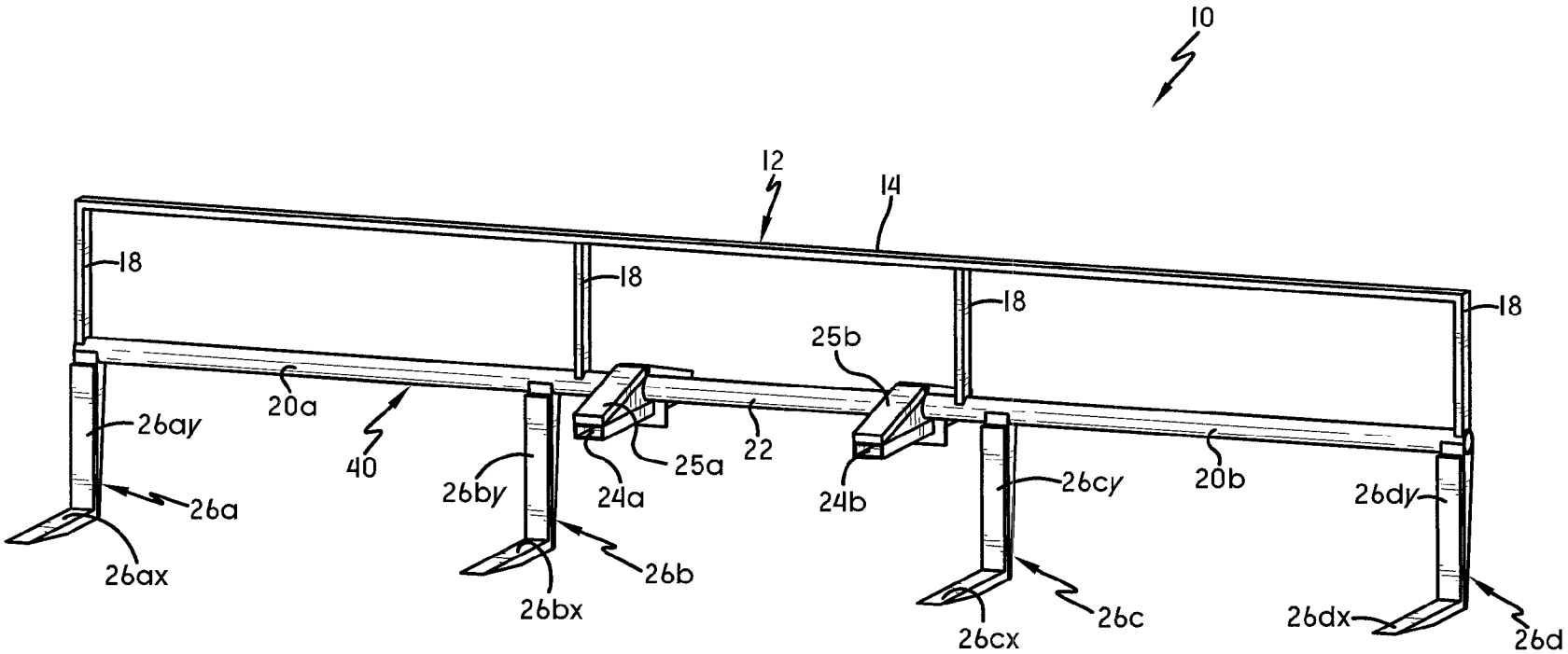
FIG. 8 is a perspective front view of an embodiment of the attachment of this invention having a differing frame body structure.
Figure 9:
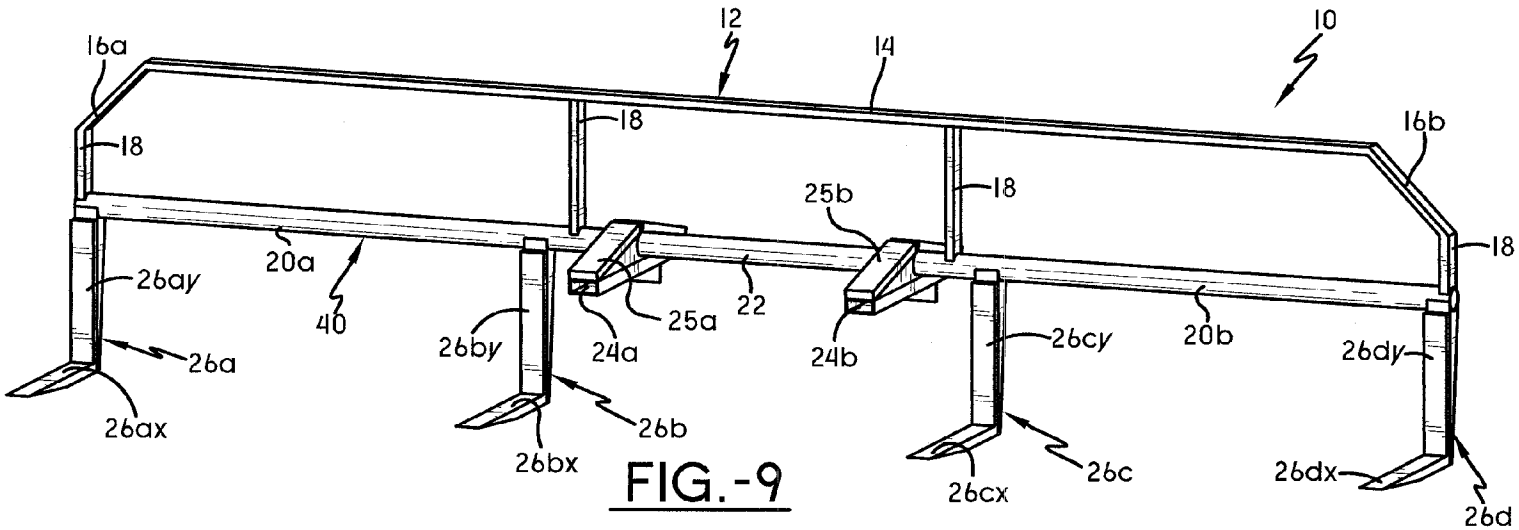
FIG. 9 is a perspective front view of an embodiment of the attachment of this invention having another differing frame body structure.
Figure 10:
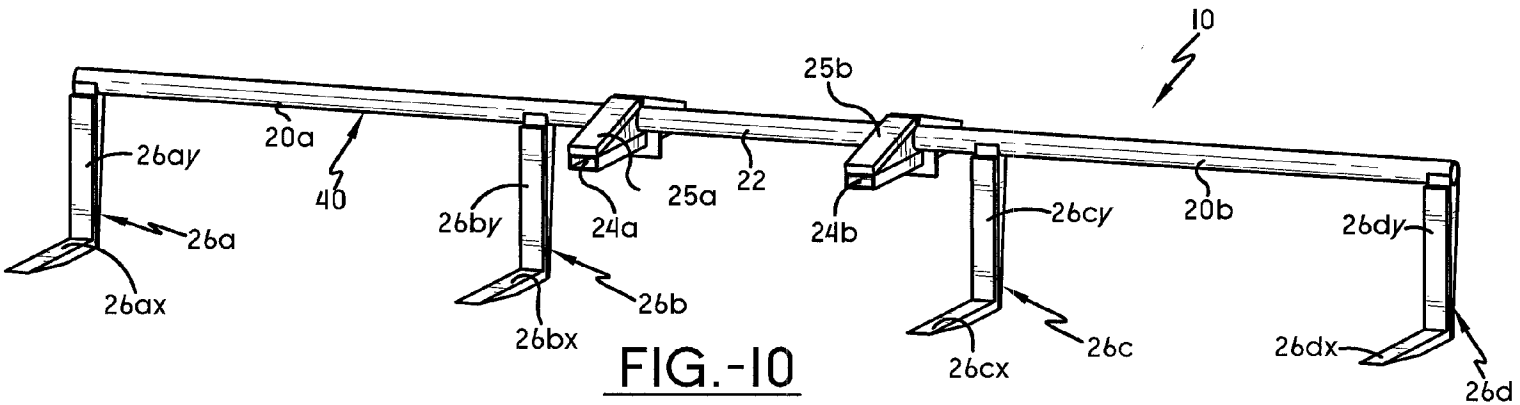
FIG. 10 is a perspective front view of an embodiment of the attachment of this invention having no frame body structure.

A preferred embodiment of the forklift attachment of the present invention is illustrated in FIGS. 1-6. Attachment 10 generally includes frame body structure 12 that connects the components of attachment 10 and provides structural support for attachment 10. In certain embodiments of the invention, as shown in FIGS. 1-6, frame body structure 12 includes top horizontal component 14, two diagonal components 16*a* and 16*b*, and one or more vertical support components 18. It is foreseen that further embodiments, such as that illustrated by FIG. 8-9, may utilize different forms for frame body structure 12. Frame body structure 12 may use top horizontal component 14, but may use numerous vertical support components 18, foregoing use of any diagonal components, as shown in FIG. 8. Differing embodiments of attachment 10 may use different variations of horizontal, vertical and diagonal components to form frame body structure 12, as shown in FIG. 9. It is foreseen, though not preferred, that no frame body structure may be used at all, as shown in FIG. 10.

Figure 7:
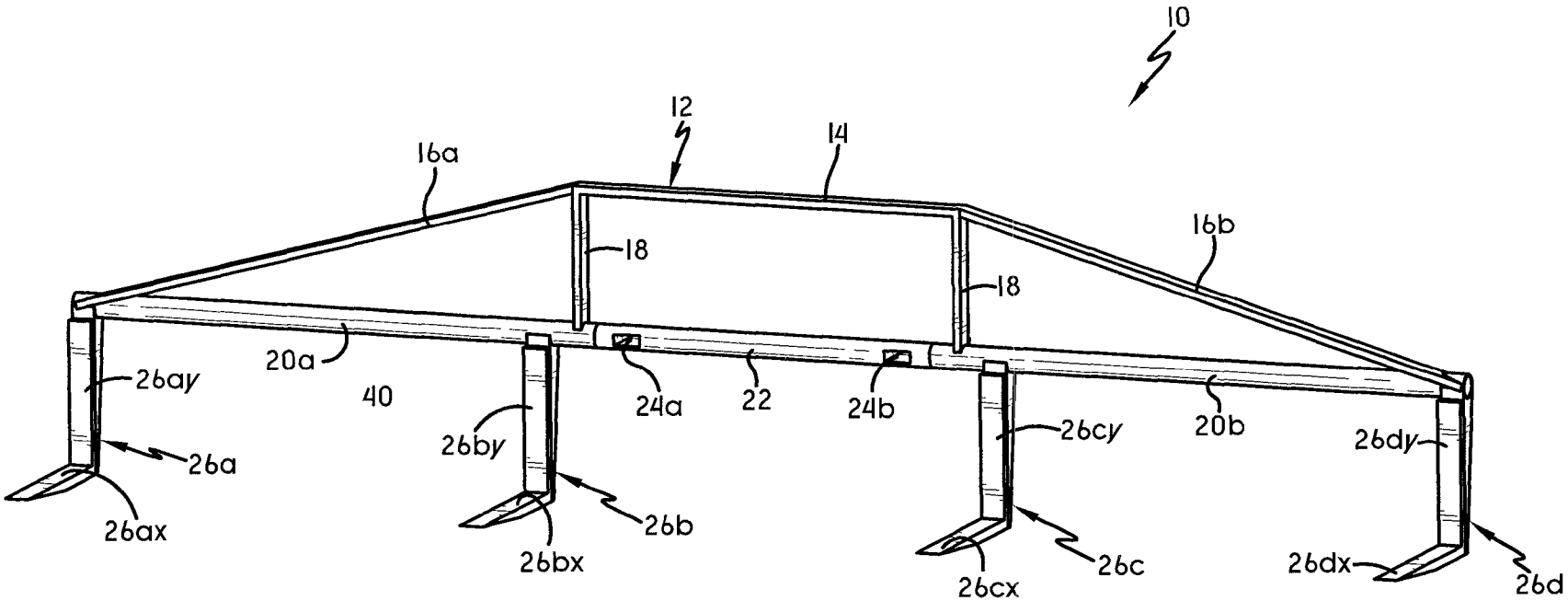
FIG. 7 is a perspective front view of an embodiment of the attachment of this invention with no opening supports.

In certain preferred embodiments, as shown in FIGS. 1-6, horizontal base bars 20*a* and 20*b* extend beyond the width of the original forks of the forklift vehicle to which attachment 10 is attached. Horizontal base bars 20*a* and 20*b* are connected to frame body structure 12. Horizontal base bars 20*a* and 20*b* are connected to horizontal connector bar 22. Horizontal connector bar 22 connects horizontal base bars 20*a* and 20*b* to one another to form horizontal extension component 40. Frame body structure 12 may attach to horizontal extension component 40 (in embodiments where frame body structure 12 exists). Certain embodiments of the invention may include a visual distinction between horizontal connector bar 22 and horizontal base bars 20*a* and 20*b*, as shown in FIG. 7. In certain other embodiments, horizontal connector bar 22 and horizontal base bar 20*a* and 20*b* may be one integrated structure, as shown in FIGS. 1-6, with no visual distinction between the components of the horizontal extension component 40. In embodiments of the invention wherein no frame body structure 12 exists, as shown in FIG. 10, horizontal extension component 40 may be the uppermost component of attachment 10.

As shown in FIGS. 1-6, horizontal extension component 40 is necessarily wider than the width of the span between the original forks of the forklift vehicle. By non-limiting example, if the original forks of a forklift vehicle span approximately 8'10.5", horizontal extension component 40 may be approximately 30' wide. These dimensions are in no way limiting, and are presented merely as an example of the dimensions of one embodiment of the invention. In further embodiments, original forks of a forklift vehicle may span 12' and horizontal extension component 40 may be approximately 16' wide. No limitations to the dimensions of this invention exist, except that horizontal extension component 40 must be wider than the width of the span between the original forks of the forklift vehicle.

Horizontal extension component 40 has openings 24*a* and 24*b* for the acceptance of the original forks of the forklift vehicle. It is foreseen by certain embodiments that openings 24*a* and 24*b* may exist through horizontal connector bar 22, but in other embodiments openings 24*a* and 24*b* may exist through any portion of horizontal extension component 40. Openings 24*a* and 24*b* may be integrated directly into horizontal extension component 40, as shown in FIG. 7. In differing embodiments, openings 24*a* and 24*b* may be supported by opening supports 25*a* and 25*b*, as shown in FIGS. 1-6. It is also foreseen in further embodiments that opening supports 25*a* and 25*b* may contain openings 24*a* and 24*b* such that openings 24*a* and 24*b* exist below horizontal extension component 40, and openings 24*a* and 24*b* do not extend through horizontal extension component 40. Typically, two openings 24*a* and 24*b* exist, to accommodate acceptance of the standard two forks on a forklift vehicle, however it is foreseen that more openings may exist, to allow the attachment to be utilized on a forklift vehicle having more than two forks. The openings will be spaced to align with the spacing of the original forks of the forklift vehicle.

Additional forks 26*a*, 26*b*, 26*c* and 26*d* are generally L-shaped and extend downwardly and project forwardly from horizontal base bars 20*a* and 20*b*. Additional forks 26 may be integrally formed or otherwise rigidly supported by horizontal base bars 20*a* and 20*b* of horizontal extension component 40. Additional forks 26 may be of the same general dimensions as the original forks of the forklift vehicle, or they may differ in dimension from the original forks. Attachment 10 uses solely additional forks 26 to transport the desired load, and does not utilize the original forks to transport the load, providing the benefit that additional forks 26 may have differing dimensions from those of the original forks.

Figure 11:
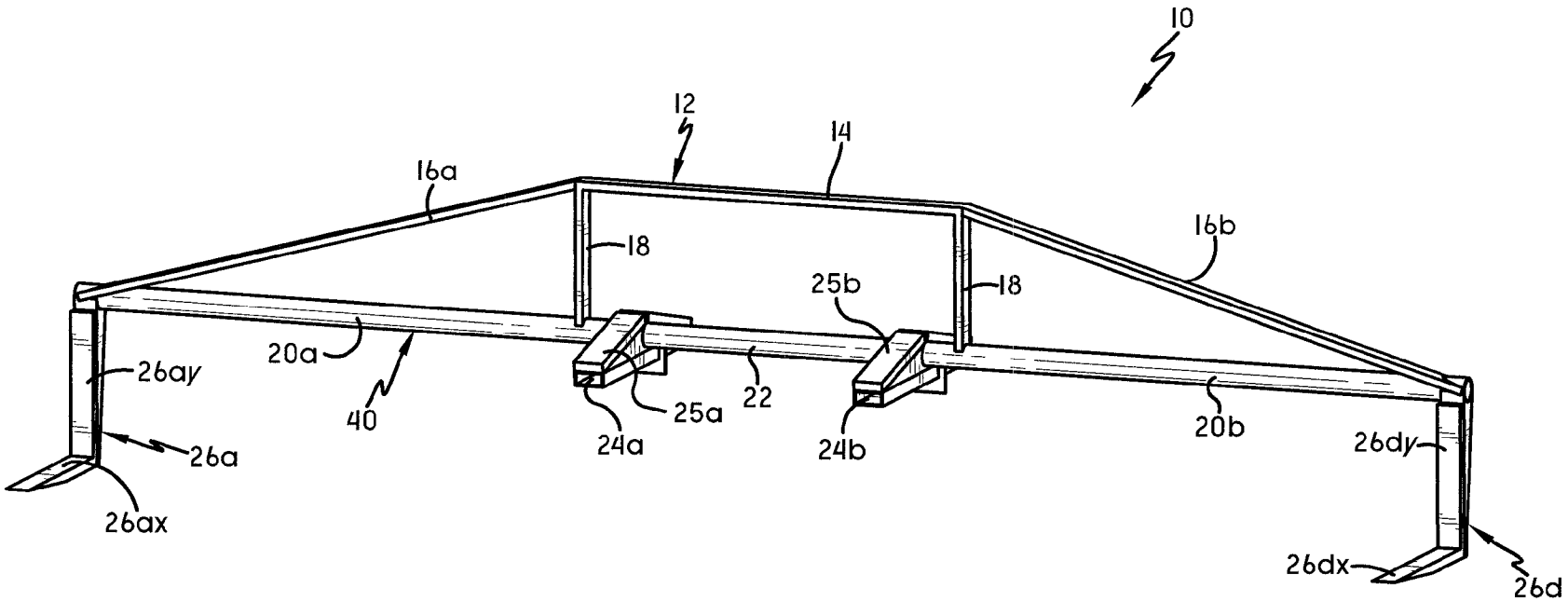
FIG. 11 is a perspective front view of an embodiment of the attachment of this invention having two additional forks.
Figure 12:
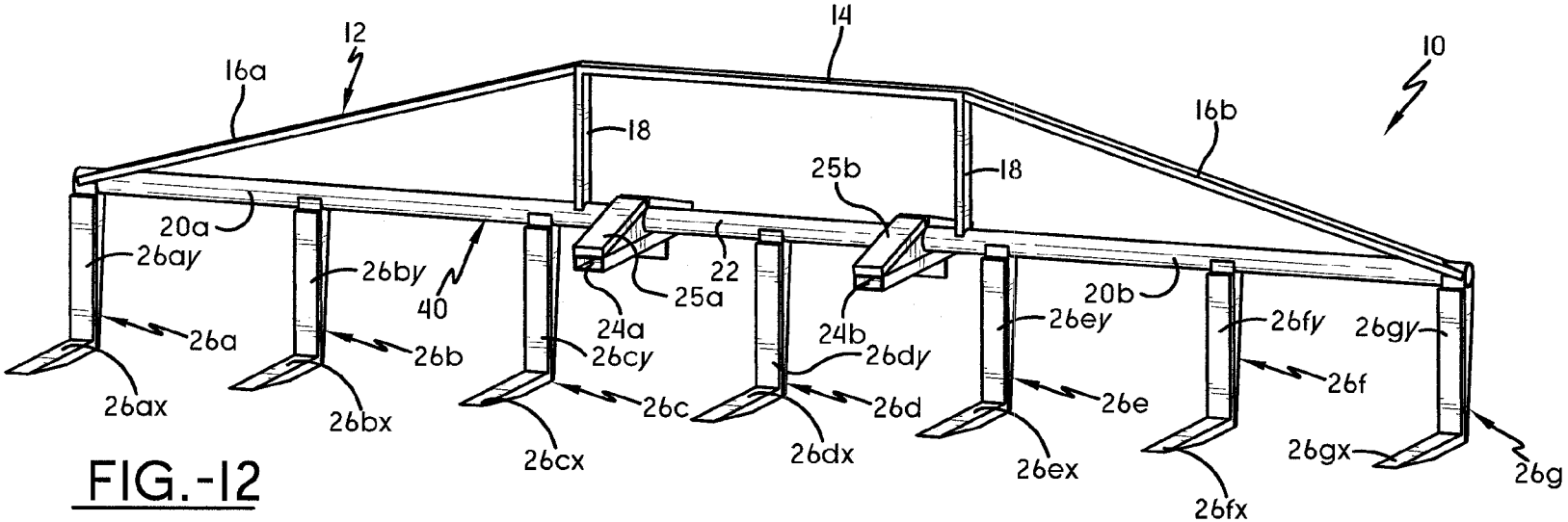
FIG. 12 is a perspective front view of an embodiment of the attachment of this invention having seven additional forks.
Figure 13:
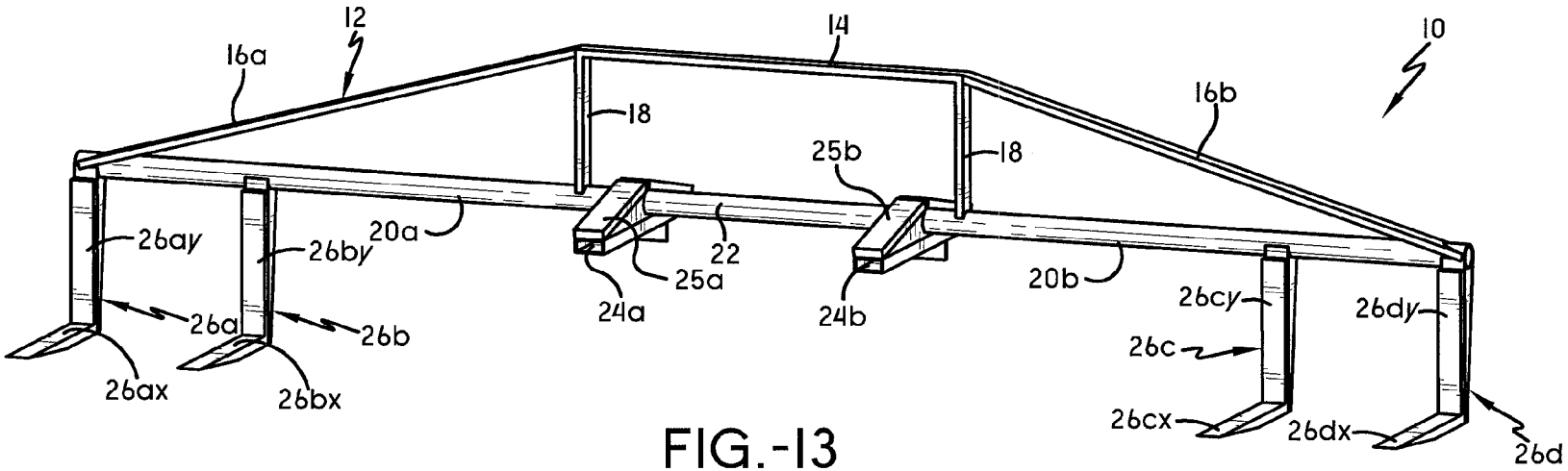
FIG. 13 is a perspective front view of an embodiment of the attachment of this invention having non-equidistantly placed additional forks.

There must be at least two additional forks 26*a* and 26*b* extending from attachment 10, but there are no further limits to the number of additional forks 26 extending from attachment 10. Additional forks 26 are generally L-shaped, as shown in the figures, and include downwardly extending portion (26*ay*, 26*by*, 26*cy*, and 26*dy*) and horizontally extending portion (26*ax*, 26*bx*, 26*cx*, and 26*dx*). Additional forks 26 are generally equidistant from one another along the length of horizontal base bars 20*a* and 20*b* to provide uniform support to the load supported by additional forks 26, however there are no limits to the placement of additional forks 26 extending from attachment 10. Varying configurations of the number and placement of additional forks 26 may be utilized in different embodiments, non-limiting examples of which are illustrated in FIGS. 11-13. More or fewer additional forks may be used—two additional forks 26*a* and 26*b* are shown in FIG. 11, seven additional forks 26*a*, 26*b*, 26*c*, 26*d*, 26*e*, 26*f* and 26*g* are shown in FIG. 12. Additional forks 26*a*, 26*b*, 26*c*, and 26*d* may also be non-equidistant, as shown in FIG. 13. Many other variations of configurations for the additional forks can be foreseen and may be implemented with the present invention. The configuration of the number and placement of the forks is variable depending on the application and characteristics of the loads being lifted by the forklift vehicle utilizing attachment 10.

It is foreseen that attachment 10 may commonly be sized to fit a standard forklift vehicle. Attachment 10 of further embodiments of this invention may be manufactured to certain size specifications as is necessary to fit on a certain forklift vehicle, and or to accommodate a certain load width or shape. The openings in horizontal connector bar may be sized and shaped to accept the original forks of a certain forklift vehicle. The additional forks may also be sized to accommodate a certain load width or shape.

Attachment 10 will most preferably be manufactured from steel or a steel alloy, to give attachment 10 the required strength, while still being affordable to manufacture. It is foreseen that the material used to manufacture attachment 10 is not limited to steel and its alloys. Any metal of sufficient strength to support the loads lifted by attachment 10 and the forklift vehicle may be used in the manufacturing of attachment 10.

Figure 14:
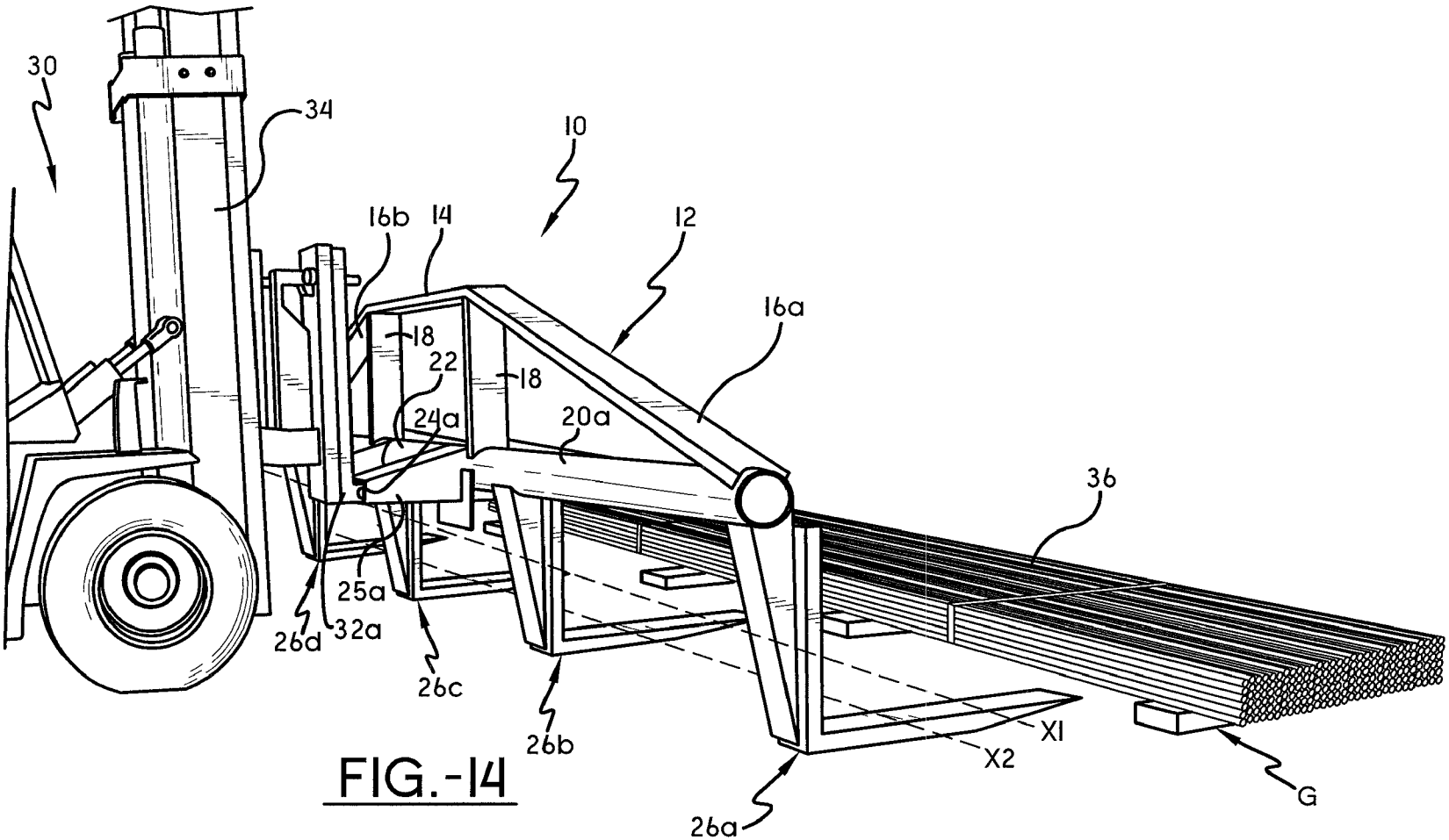
FIG. 14 is a perspective view of an embodiment of the attachment of this invention attached to a forklift vehicle.

As the structure of various embodiments of attachment 10 has been described above and illustrated in FIGS. 1-13, the method of attachment and use of attachment 10 with a forklift vehicle will now be described and illustrated. FIG. 14 illustrates attachment 10 of an embodiment of this invention as applied to forklift vehicle 30. Original forks 32*a* and 32*b* of forklift vehicle 30 are positioned to align with openings 24*a* and 24*b* within horizontal connector bar 22 of attachment 10. Original forks 32*a* and 32*b* are inserted into openings 24*a* and 24*b*, to connect attachment 10 with forklift vehicle 30. Original forks 32*a* and 32*b* are fully inserted into openings 24*a* and 24*b* such that the back portion of horizontal connector bar 22 is stopped by the front portion of mast 34 of forklift vehicle 30. In certain embodiments, opening supports 25*a* and 25*b* and openings 24*a* and 24*b* are sized so a substantial portion of original forks 32*a* and 32*b* are visible and extend through openings 24*a* and 24*b*. In other embodiments, original forks 32*a* and 32*b* are encased within openings 24*a* and 24*b* and do not extend fully through attachment 10. When attachment 10 is properly engaged with forklift vehicle 30, attachment 10 will rise when mast 34 is raised, lifting original forks 32*a* and 32*b* and connected attachment 10.

When original forks 32*a* and 32*b* are engaged in openings 24*a* and 24*b*, additional forks 26 are aligned on horizontal plane X2, as shown in FIG. 14, which lies below the horizontal plane X1 that the original forks 32*a* and 32*b* exist on. Original forks 32*a* and 32*b* are used solely to engage attachment 10, and are not used to contact or lift a load, as they were originally intended to do. When attachment 10 is in place on forklift vehicle 30 additional forks 26 are solely responsible for engaging and contacting the load lifted by forklift vehicle 30.

Figure 15:
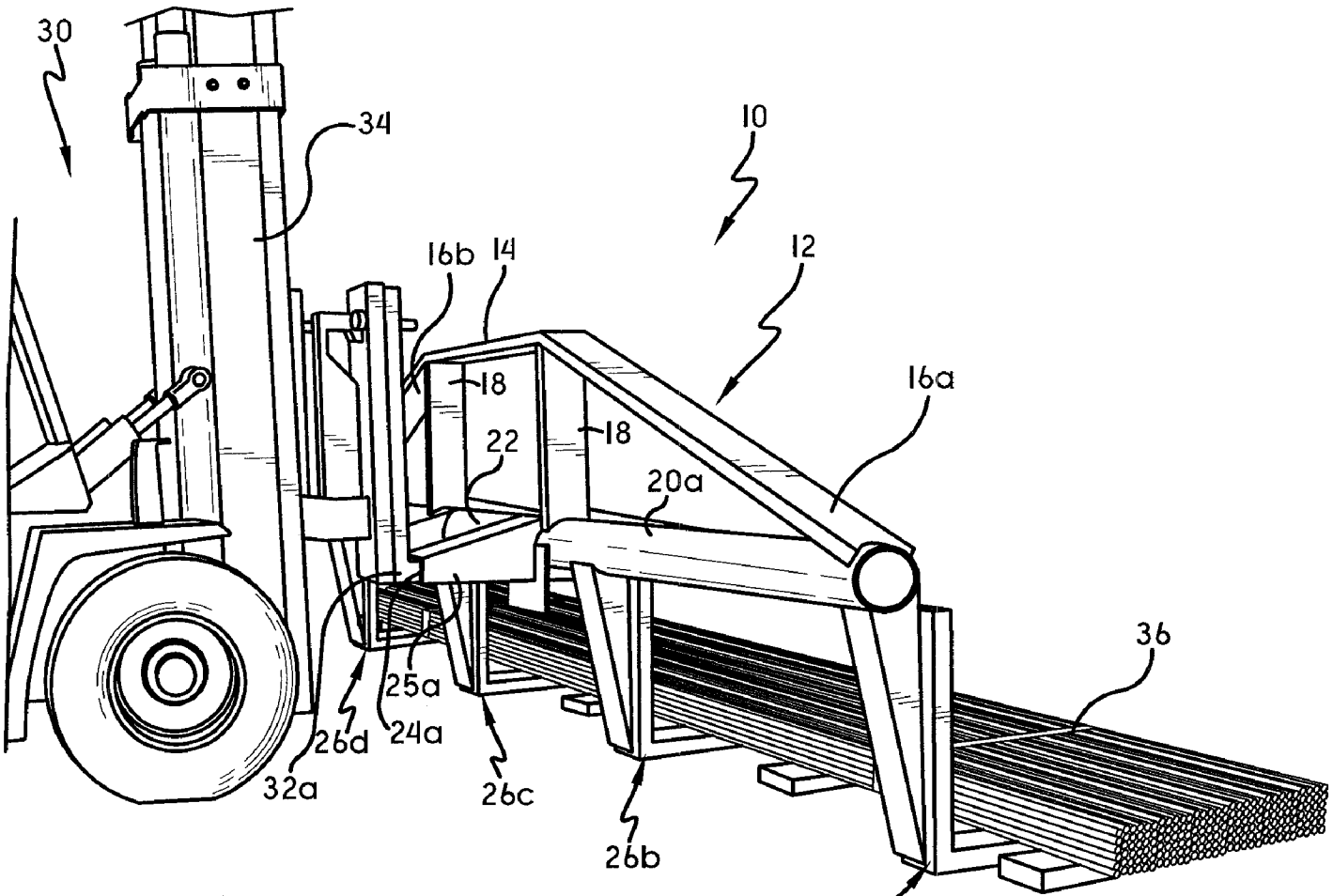
FIG. 15 is a perspective view of an embodiment of the attachment of this invention attached to a forklift vehicle engaging a load.
Figure 16:
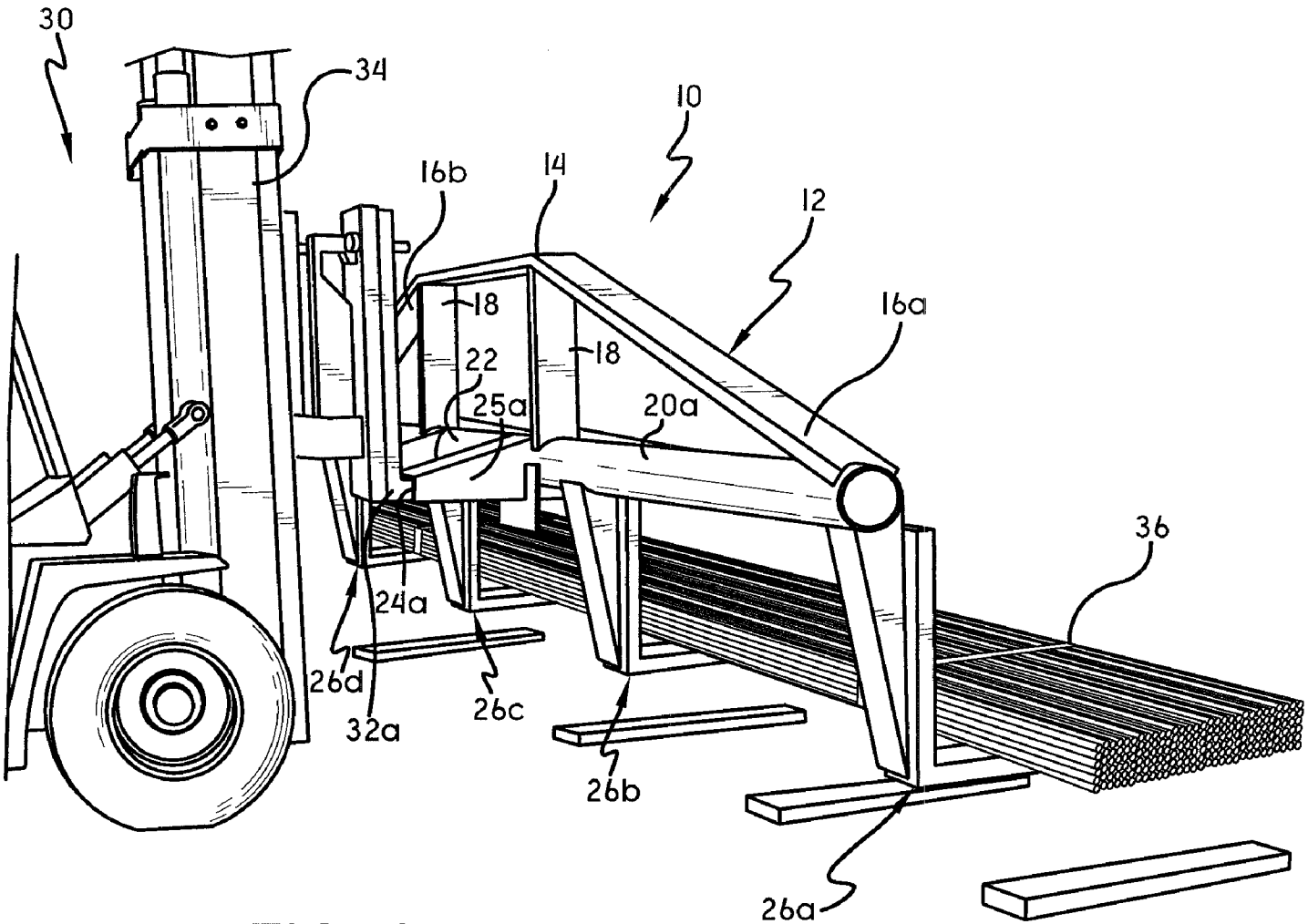
FIG. 16 is a perspective view of an embodiment of the attachment of this invention attached to a forklift vehicle transporting a load.

FIG. 15 illustrates forklift vehicle 30 with attachment 10 engaging a load to transport, and FIG. 16 illustrates forklift vehicle 30 with attachment 10 transporting load 36. When transporting load 36 using attachment 10, the operator of forklift vehicle 30 directs forklift vehicle 30 and approaches load 36. Forklift vehicle 30 is generally centered in front of load 36. Additional forks 26 are aligned such that they can be lowered towards ground plane G upon which load 36 rests, in near vicinity to load 36. Mast 34 lowers attachment 10 towards ground plane G, and pushes additional forks 26 forward, engaging additional forks 26 below and in contact with load 36. Mast 34 then rises, lifting attachment 10, and consequently load 36 that is in contact and resting on additional forks 26. Forklift vehicle 30 is capable of transporting wider loads using attachment 10 than without using attachment 10 due to the increased span provided by additional forks 26 of attachment 10.

To remove attachment 10 from forklift vehicle 30, mast 34 lowers until attachment 10 is resting on the ground. In the same lowered position, forklift vehicle 30 moves in reverse, sliding original forks 32*a* and 32*b* from openings 24*a* and 24*b*. When original forks 32*a* and 32*b* are full removed from openings 24*a* and 24*b* attachment should remain on the ground, separated from forklift vehicle 30. When attachment 10 is removed from forklift vehicle 30, forklift vehicle 30 functions as originally intended.

Described generally herein is an embodiment of an attachment for a forklift vehicle, the vehicle having at least two original forks separated by a width, which includes a horizontal extension component. The horizontal extension component has a width greater than the width of the original forks of the vehicle. The horizontal extension component further has at least two openings therein, wherein the at least two openings are sized for the acceptance of the original forks of the vehicle and are spaced at the width of the original forks. The attachment also includes at least two additional forks connected to the horizontal extension component, wherein the additional forks extend downwardly and forwardly from the horizontal extension component and are spaced at a width greater than the width of the original forks. Certain embodiments of the invention may also include a frame body structure that connects to the horizontal extension component.

A further embodiment of the invention described herein is an attachment for a forklift vehicle, the vehicle having at least two original forks separated by a width, which includes, a horizontal extension component. The horizontal extension component has a width greater than the width of the original forks. The attachment further includes at least two opening supports connected to the horizontal extension component wherein each of the opening supports has an opening therein, wherein the openings are sized for the acceptance of the original forks and the opening supports are spaced at the width of the original forks. The attachment also includes at least two additional forks connected to the horizontal extension component, wherein the additional forks extend downwardly and forwardly from the horizontal extension component and the additional forks are spaced at a width greater than the width of the original forks.

Yet another embodiment of the invention described herein is an attachment for a forklift vehicle, the vehicle having at least two original forks separated by a width, which includes a frame body structure and a horizontal extension component. The horizontal extension component has a width greater than the width of the original forks of the vehicle, and further wherein the horizontal extension component connects to the frame body structure and has at least two openings therein, wherein the at least two openings are sized for the acceptance of the original forks of the vehicle. The attachment also includes at least two additional forks connected to the horizontal extension component, wherein the at least two additional forks extend downwardly and forwardly from the horizontal extension component and further wherein the additional forks are spaced at a width greater than the width of the original forks.

Another embodiment of the invention described herein is an attachment for a forklift vehicle, the vehicle having at least two original forks separated by a width, which includes a frame body structure and a horizontal extension component. The horizontal extension component has a width greater than the width of the original forks of the vehicle. The horizontal extension component includes two horizontal base bars, wherein each of the two horizontal base bars includes an outer end and an inner end, and further wherein the two horizontal base bars are connected to the frame body structure at the outer end of each horizontal base bar of the two horizontal base bars; and a horizontal connector bar, wherein the horizontal connector bar connects the two horizontal base bars at the inner end of each of the two horizontal base bars. The horizontal connector bar has at least two openings therein, wherein the openings are sized for the acceptance of the original forks of the vehicle. The attachment further includes at least two additional forks connected to the horizontal extension component, wherein the additional forks extend downwardly and forwardly from the horizontal extension component.

The invention has been described with reference to at least one embodiment. Obviously, modifications and alterations will occur to others upon a reading and understanding of this specification. It is intended to include all such modifications and alternatives in so far as they come within the scope of the appended claims or the equivalence thereof.

In the foregoing description, certain terms have been used for brevity, clearness, illustration and understanding; but no unnecessary limitations are to be implied therefrom beyond the requirements of the prior art, because such terms are used for descriptive purposes and are intended to be broadly construed. Moreover, this invention has been described in detail with reference to specific embodiments thereof, including the respective best modes for carrying out each embodiment. It shall be understood that these illustrations are by way of example and not by way of limitation.

What is claimed is:

1. An attachment for a forklift vehicle, said vehicle having at least two original forks separated by a width, which comprises:

a horizontal extension component, wherein said horizontal extension component has a width greater than said width of said original forks, and further wherein said horizontal extension component has at least two openings therein, wherein said at least two openings are sized for the acceptance of said original forks and spaced at said width of said original forks, and wherein said horizontal extension component is one integrated structure, comprising two round, horizontal base bars and a round, horizontal connector bar that connects the two round, horizontal base bars together; and at least two additional forks connected to said horizontal extension component, wherein said additional forks extend downwardly and forwardly from said horizontal extension component and said additional forks are spaced at a width greater than said width of said original forks, and wherein the additional forks are aligned on a horizontal plane beneath a horizontal plane of the original forks; and a frame body structure that connects to said horizontal extension component, wherein said frame body structure comprises at least a pair of upwardly extending bars positioned interiorly of said width of said horizontal extension component.

2. The attachment of claim 1 which further comprises at least two opening supports surrounding said at least two openings.

3. The attachment of claim 1 wherein said attachment is constructed of steel.

4. An attachment for a forklift vehicle, said vehicle having at least two original forks separated by a width, which comprises:

a horizontal extension component, wherein said horizontal extension component has a width greater than said width of said original forks, and wherein said horizontal extension component is one integrated structure, comprising two round, horizontal base bars and a round, horizontal connector bar that connects the two round, horizontal base bars together;

at least two opening supports connected to said horizontal extension component wherein each of said opening supports has an opening therein, wherein each of said openings are sized for the acceptance of said original forks and further wherein said opening supports are spaced at said width of said original forks; and at least two additional forks connected to said horizontal extension component, wherein said additional forks extend downwardly and forwardly from said horizontal extension component and said additional forks are spaced at a width greater than said width of said original forks, and wherein the additional forks are aligned on a horizontal plane beneath a horizontal plane of the original forks; and a frame body structure that connects to said horizontal extension component, comprising a pair of upwardly extending bars positioned interiorly of said width of said horizontal extension component; a horizontal frame component connecting said pair of upwardly extending bars; and two diagonal frame components connecting said horizontal frame component to said horizontal extension component.

5. The attachment of claim 4 wherein said attachment is constructed of steel.

6. An attachment for a forklift vehicle, said vehicle having at least two original forks separated by a width, which comprises:

a horizontal extension component, wherein said horizontal extension component has a width greater than said width of said original forks of said vehicle, and further wherein said horizontal extension component comprises two round, horizontal base bars that are connected to said frame body structure; and a round, horizontal connector bar that connects said two round, horizontal base bars, and further wherein said round, horizontal connector bar has at least two openings therein, wherein said openings are sized for the acceptance of said original forks of said vehicle;

a frame body structure, wherein said frame body structure comprises at least a pair of upwardly extending bars positioned interiorly of said width of said horizontal extension component; and at least two additional forks connected to said horizontal extension component, wherein said at least two additional forks extend downwardly and forwardly from said horizontal extension component and further wherein said additional forks are spaced at a width greater than said width of said original forks, and wherein the additional forks are the only forks that contact a load.

7. The attachment of claim 6 wherein said frame body structure comprises:

at least one horizontal frame component connecting said pair of upwardly extending bars.

8. The attachment of claim 6 wherein said frame body structure further comprises:

at least one horizontal frame component connecting said pair of upwardly extending bars; and at least two diagonal frame components, wherein said diagonal frame components connect said at least one horizontal frame component to said horizontal extension component.

9. The attachment of claim 6 which further comprises at least two opening supports surrounding said at least two openings.

10. The attachment of claim 6 wherein said attachment is constructed of steel.

11. An attachment for a forklift vehicle, said vehicle having at least two original forks separated by a width, which comprises:

a horizontal extension component, wherein said horizontal extension component has a width greater than said width of said original forks of said vehicle, and further wherein said horizontal extension component comprises:

two round, horizontal base bars, wherein said two round, horizontal base bars are connected to said frame body structure; and a round, horizontal connector bar, wherein said round, horizontal connector bar connects said two round, horizontal base bars, and further wherein said round, horizontal connector bar has at least two openings therein, wherein said openings are sized for the acceptance of said original forks of said vehicle;

a frame body structure, wherein said frame body structure comprises a pair of upwardly extending bars positioned interiorly of said width of said horizontal extension component; a horizontal frame component connecting said pair of upwardly extending bars; and two diagonal frame components connecting said horizontal frame component to said horizontal extension component; and at least two additional forks connected to said horizontal extension component, wherein said additional forks extend downwardly and forwardly from said horizontal extension component and further wherein said additional forks are spaced at a width greater than said width of said original forks, and wherein the additional forks are the only forks that contact a load.

12. The attachment of claim 11 wherein said horizontal base bars and said horizontal connector bar are one integrated structure.

13. The attachment of claim 11 which further comprises at least two opening supports surrounding said at least two openings.

14. The attachment of claim 11 wherein said attachment is constructed of steel.

* * * * *